United States Patent [19]

Kimura

[11] 4,270,289

[45] Jun. 2, 1981

[54] CARD HOLDER

[75] Inventor: Yoshimi Kimura, Nagareyama, Japan

[73] Assignee: Kabushiki Kaisha Fuji Seisakusho, Nagaretana, Japan

[21] Appl. No.: 103,240

[22] Filed: Dec. 13, 1979

[30] Foreign Application Priority Data

Dec. 18, 1978 [JP] Japan ..... 53-172148[U]
Jun. 30, 1979 [JP] Japan ..... 54-90440[U]

[51] Int. Cl.[3] ..... G09F 11/08
[52] U.S. Cl. ..... 40/379; 40/377
[58] Field of Search ..... 40/379, 377, 378, 371, 40/373, 388, 405, 493, 494, 497, 501, 526, 527, 537, 359

[56] References Cited

U.S. PATENT DOCUMENTS

| | | | |
|---|---|---|---|
| 1,001,124 | 8/1911 | Daniel | 40/377 |
| 1,637,536 | 8/1927 | Rand | 40/377 |
| 1,868,156 | 7/1932 | Auerbach | 40/405 X |
| 3,661,273 | 5/1972 | Crosslen | 40/497 X |
| 3,943,647 | 3/1976 | Holtsch | 40/377 |
| 4,031,647 | 6/1977 | Thomas | 40/359 |
| 4,060,919 | 12/1977 | Sasaki et al. | 40/497 X |

*Primary Examiner*—John F. Pitrelli
*Attorney, Agent, or Firm*—Polster, Polster and Lucchesi

[57] ABSTRACT

A card holder for a rotary type information retrieving device such as a telephone number list, address list, and so on, in which a plurality of information-containing card cases are hangingly supported between a pair of mutually spaced rotary discs. In the present invention, a plurality of pins are projectively provided on the mutually opposed surfaces of the pair of rotary discs around their circumference and at an equal space interval provided among them, and a plurality of the information-containing card cases are hangingly supported between the rotary discs by the inwardly projected pins thereon. Each card case is formed by folding a single sheet of film material into a folder shape, and its bent portion, either in a single U-shape or in a circular shape in its cross-section, is made a pin insertion engagement part. The rotary disc has a concentric raised part at a position inside the train of the pins to prevent the card case from slipping out of the pin when it arrives at an upper position of the rotary disc in case the pin insertion engagement part is in a simple U-shaped cross-section, but has no such raised part when the bent portion is in a circular cross-section.

4 Claims, 14 Drawing Figures

CARD HOLDER

BACKGROUND OF THE INVENTION

This invention relates to a card holding device for use in a rotary type information extracting or retrieving device of a relatively small type which is used for a telephone number list, address list, and so forth.

This type of card holder, in its conventional form, is in such a construction that a plurality of holes 2 are perforated at an equal space interval on one and the same circumferential surface of a pair of left and right rotary discs 1, 1, into each of which both end parts of a shaft or pin 4 of a card case 3 are inserted to thereby hold the card case hangingly between the left and right rotary discs 1, 1, as shown in the accompanying drawing (FIGS. 1 and 2). In this instance, the card case 3 is so manufactured that a single sheet of transparent plastic film is folded into to portions or flaps along its lengthwise direction, and a thin axle shaft or pin 4 of plastic material is placed on the inner edge of one of the folded flaps along its lengthwise direction, and fixed thereto with an adhesive or a fusing material. In this illustrated prior art card holder, a reference numeral 5 designates a side bent portion for preventing the card in the case from slipping out sidewise, and a numeral 6 refers to a finger tip engagement part for inserting and drawing the card in and out of the card case.

However, since the abovementioned axle pin 4 is as thin as 2 mm or so in diameter, it is very difficult to obtain the same in straight at the time of its shaping. On account of this, the axle pin 4 is rather difficult to be adhered onto the main body of the card case, which requires much trouble in straightening the same. Furthermore, due to curving of the axle pin 4, the end parts of it and the hole 2 in the rotary discs 1, 1 do not mutually agree at the time of assembling the card case 3 with the left and right rotary discs 1, 1, thereby making it difficult to insert the axle shaft into the hole in the rotary discs.

SUMMARY OF THE INVENTION

The present invention has been made in view of the above-described disadvantage inherent in the conventional device, and aims at providing an improved card holder which is so constructed that a plurality of pins corresponding to the abovementioned axle shaft or pin are embedded around the circumferential surfaces of the rotary discs, and each card case is hanging supported on a pair of mutually opposed pins, thereby facilitating manufacturing of the card case.

It is another object of the present invention to provide a card holder; in which the assembly of the card case and the rotary disc can be done in a simple operation.

According to the present invention, in one aspect thereof, there is provided a card holder for a rotary type information retrieving device, wherein a plurality of information-containing card cases are hangingly supported between a pair of mutually spaced rotary disces, and which comprises: a plurality of pins arranged on one suface of each of said pair of rotary discs around the circumference thereof and at an equal space interval provided among them; a concentric raised part provided on the same surface side of said pair of rotary discs at a position inward of said train of pins; and a plurality of information-containing card cases, each being formed by folding a single sheet of film material into a folder shape with the bent portion thereof being made a pin insertion engagement part so that each of said card cases may be hangingly supported between said pair of rotary discs by said oppositely arranged pins on the circumferential surfaces of said discs, one of said folded flaps of the card case being further bent at its edge opposite to said bent portion toward the other flap to constitute a slip-preventive section for the information card inserted between the two folded flaps of said card case.

According to the present invention, in another aspect thereof, there is provided a card holder for a rotary type information retrieving device, wherein a plurality of information-containing card cases are hangingly supported between a pair of mutually spaced rotary discs, and which comprises: a plurality of pins arranged on one surface of each of said pair of rotary discs around the circumference thereof and at an equal space interval among them; and a plurality of information-containing card cases, each being formed by folding a single sheet of film material into a folder shape with the bent portion being made a pin insertion engagement part in a substantially circular cross-sectional shape so that said engagement portion may not move in the direction where said pins orthogonally intersect with the axial line thereof, said each card case being hangingly supported on said pair of rotary discs through said oppositely arranged pins on the circumference of said discs, one of said two bent flaps of said card case being further bent at its edge opposite to said bent portion toward the other flap to constitute a slip-preventive section for the information card inserted between the two-folded flaps of said card case.

There have thus been outlined, rather broadly, the more important features of the present invention in order that the detailed description thereof that follows may be better understood, and in order that the present contribution to the art may be better appreciated. There are, of course, additional feature of the invention that will be described hereinafter and which will form the subject of the claims appended hereto. Those skilled in the art will appreciate that the conception, upon which this disclosure is based may readily be utilized as a basis for the designing of other structures for carrying out the several purposes of the present invention. It is important, therefore, that the claims be regarded as including such equivalent construction so far as they do not depart from the spirit and scope of the present invention.

BRIEF DESCRIPTION OF ACCOMPANYING DRAWING

Specific embodiments of the present invention have been chosen for the purpose of illustration and description, and are shown in the accompanying drawing, forming a part of the specification, in which.

DETAILED DESCRIPTION OF PREFERRED EMBODIMENTS

Figure 1:
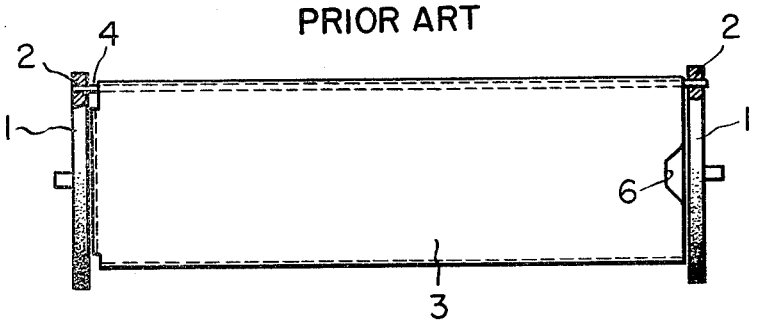
FIG. 1 PRIOR ART
FIG. 1 is a front view showing a conventional card case.
Figure 2:
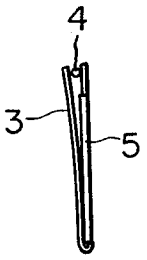
PRIOR ART FIG. 2
FIG. 2 is a side view of the card case shown in FIG. 1.
Figure 3:
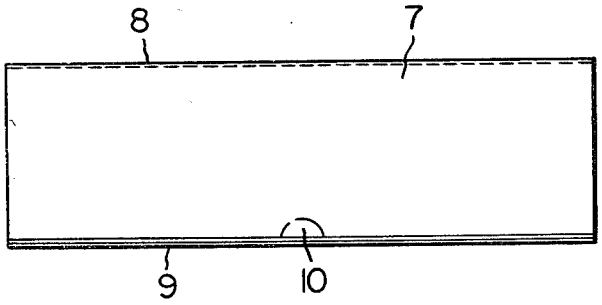
FIG. 3 is a front view showing a preferred embodiment of the card case according to the present invention.
Figure 4:
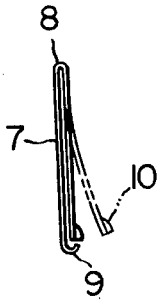
FIG. 4 is a side view of the card case shown in FIG. 3.

Referring to FIGS. 3 and 4 showing a first embodiment of the card case according to the present invention, the card case 7 is formed by bending a single sheet of transparent plastic film into substantially equal two portions or flaps with the upper bent portion being made a pin insertion engagement part 8, and with the lower edge of one of the folded flaps being further bent toward the other flap along its lengthwise direction to form a preventive portion 9 of the card from slipping out. A reference numeral 10 designates a finger tip engagement part.

Figure 6:
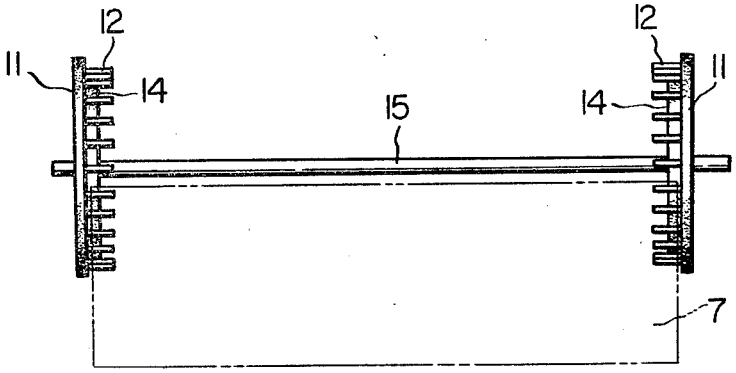
FIG. 6 is a front view showing a state of mounting the rotary discs on a shaft.
Figure 5:
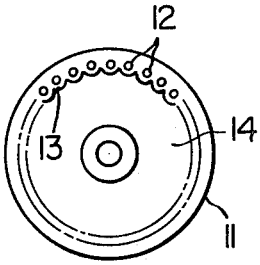
FIG. 5 is a side view of a rotary disc according to the present invention.

FIG. 5 shows a rotary disc 11 according to the present invention. The disc has a plurality of pins 12 embedded on one circumferential surface part of the rotary disc at an equal space interval provided among them. It also has a concentric raised part 14 inward of the circularly arranged train of the pins 12 with its outer periphery being shaped in a wavy form 13 in conformity to the outer shape of each of the pins. Two rotary discs 11, 11 are fixedly secured on a shaft 15 with their surface having the pins thereon being confronted each other and at a space interval slightly wider than the horizontal length of the card case 7, as shown in FIG. 6.

Figure 7:
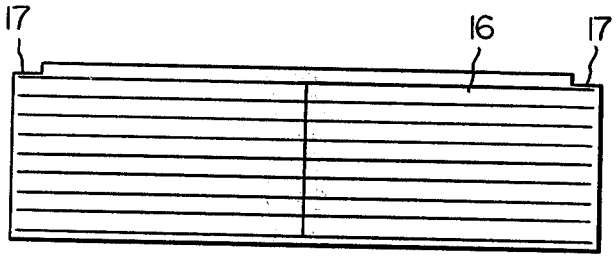
FIG. 7 is a front view of a card for information entry therein.

FIG. 7 shows a card 16 for entry of various informations therein and to be placed in the card case according to the present invention. The card has notched portions 17, 17 on both upper corners thereof in the lengthwise direction, for the reason to be mentioned later.

Figure 8:
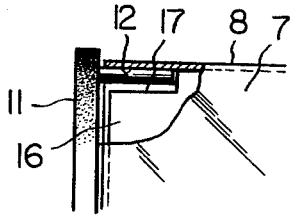
FIG. 8 is a partial front view showing a state of assmebly of the rotary disc and the card case.

In order to hangingly support the card case 7 together with the abovementioned information card placed therein between the oppositely arranged rotary discs 11, 11, a user places his finger on the finger tip engagement part 10 of the card case 7 to open the same, and then inserts the card 16 into it with the notched portions 17, 17 being directed toward the pin insertion engagement part 8. Thereafter, one side, e.g., the right side, of the pin insertion engagement part 8 of the card case 7 is inserted into any one of the pins 12 on the rotary disc 11 at the right side, and then the card case 7 is slightly curved in its longitudinal direction to cause the pin insertion engagement part at its left side to be engaged with one of the pins 12 on the left side disc 11, thereby hangingly holding the card case 7 between the left and right rotary discs 11, 11 (vide: FIG. 8).

At the time of engaging the card case 7 with the abovementioned pins 12, the pins are inserted into both ends of the card at its pin insertion engagement parts 8, the insertion of which is permitted by the notched portions 17, 17 formed on both upper corners of the card 16. The sidewise movement of the card 16 is restricted by the contact of the abovementioned notched portions 17 and the pins 12 at their end faces.

In the actual use of the card, when the rotary discs 11, 11 in rotation stop at a predetermined position, there will be exerted a force to the card case 7, situated on the upper side of the rotary disc 11, which tends to cause the card case 7 to slip downward from the pins 12. However, since the outer surface of the pin insertion engagement part 8 of the card case 7 contacts the semicircular recess 13 formed around the raised circular part 14, there is no possibility of the card case 7 being slipped out of the pins 12. It is to be noted that the abovementioned rotary disc 11, the pins 12 and the raised part 14 may be integrally formed of a plastic material.

Figure 9:
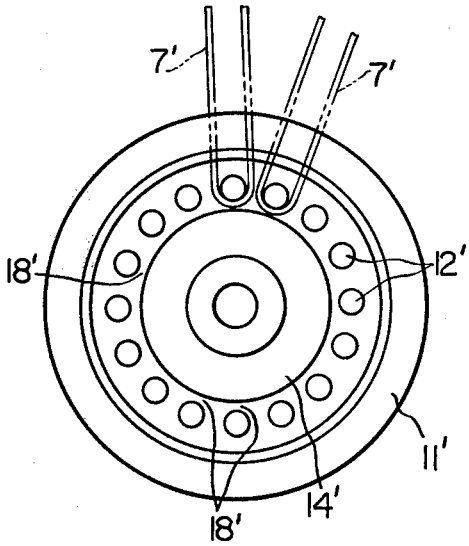
FIG. 9 is a side view showing a modified embodiment of the rotary disc.
Figure 10:
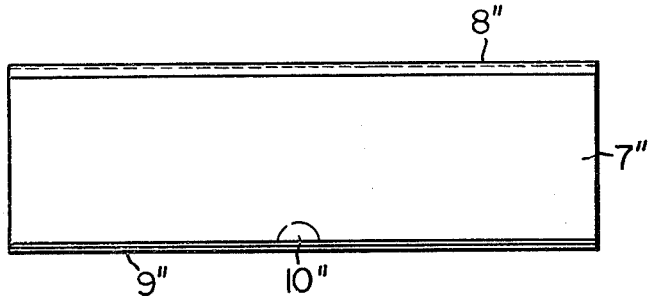
FIG. 10 is a front view showing another preferred embodiment of the card case according to the present invention.
Figure 11:
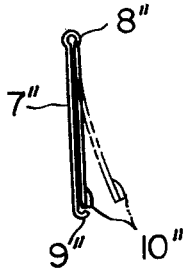
FIG. 11 is a side view of the card case shown in FIG. 10.
Figure 12:
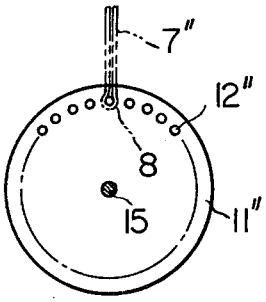
FIG. 12 is a side view of the rotary disc in accordance with another embodiment of the present invention.
Figure 13:
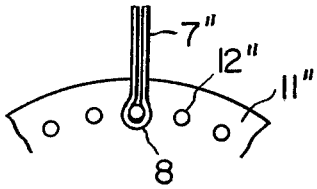
FIG. 13 is also a side view, in an enlarged scale, of the rotary disc shown in FIG. 12.
Figure 14:
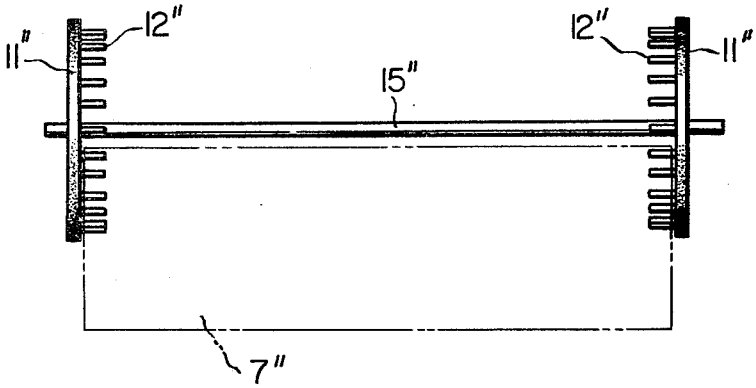
FIG. 14 is a front view showing a state of mounting the rotary discs, in another embodiment, on a shaft.

FIG. 9 shows a modification of the rotary disc 11, indicated by reference number 11′, wherein a clearance substantially equal to the thickness of a card case 7′ is formed between a raised circular part 14′ and pins 12′ to make the peripheral surface of the raised circular part 14′ smooth.

Since the card holder according to the present invention can be obtained by simply bending a single sheet of plastic film into a folder shape, there is no necessity for adhesion of the holding pin to the card case as so far been practiced, whereby the manufacturing steps can be remarkably reduced. Further, accurate positioning of the pins around the circumference of the rotary disc, 11′ is facilitated, so that the card case can be fitted on the rotary discs with an extremely simple operation.

According to the afore-described embodiments of the present invention, it is easy to manufacture the card case 7, 7′ by simply bending a single sheet of a plastic film into a folder shape. However, with a view to preventing the card case in the folder shape from slipping out of the pins when it is situated on the upper side of the rotary disc 11, 11′ due to its pin insertion engagement part 8, 8′ being in a simple U-shaped cross-section as illustrated, the raised circular part 14, 14′ should be provided as the slip-preventive means concentrically with the rotary disc and at a position inward of the circularly arranged train of pins on one circumferential surface of the rotary disc 11, 11′ as shown in FIGS. 5 and 9, so as to receive the ridge of the card case on its peripheral surface along the direction of the axial line.

If this raised circular part 14, 14′ can be omitted, and yet slipping of the card case from the pin 12, 12′ can be still prevented, the manufacturing of the rotary disc will become simpler, and the disc itself will reduce its weight to assure more smooth rotation. The second embodiment of the present invention is directed to attain this objective.

As the means for attaining this purpose, the neighborhood area of the bent portion in the card case 7 is shaped in a substantially circular form in its cross-section as shown in card case 7″ in FIGS. 10 to 13 by subjecting the portion to a shaping work so that the bent portion, i.e., the pin insertion engagement part, may not move in the direction where a pin 12″ orthogonally intersects with the axial line. In the drawing, a reference numeral 9″ designates a slip-preventive section for the card formed by bending one of the folded flaps along the edge in the lengthwise direction thereof toward the edge of the other flap, and a numeral 10″ refers to a finger tip engagement part as formed by extrusion. In the same manner as mentioned in the first embodiment, a rotary disc 11" may be formed of a plastic material integral with the pins 12".

Since, according to the second embodiment of the present invention, the card case is manufactured by folding a single sheet of plastic film material into two flaps, and the bearing portion is formed in a substantially circular form in its cross-section so that the bent portion of the card case may not move in the direction where the pins orthogonally intersect with the axial line, there is no possibility at all that the card case get off the pins even in the absence of the raised circular part on the rotary disc to receive the card case at its ridge, as in the first embodiment. Accordingly, the rotary disc reduces its weight for the raised circular part omitted therefrom, whereby rotation of the rotary discs becomes very smooth for the information retrieving operation.

What is claimed is:

1. In a card holder for a rotary type information retrieving device, wherein a plurality of information-containing card cases are hangingly supported between a pair of mutually spaced rotary discs, a combination which comprises:

(a) a plurality of pins arranged on one surface of each of said pair of rotary discs around the circumference thereof and at an equal space interval provided among them;

(b) a concentric raised part provided on the same surface of said pair of rotary discs at a position inward of said train of pins; and (c) a plurality of information-containing card cases, each being formed by folding a single sheet of film material into a folder shape with the bent portion being made a pin insertion engagement part so that each of said card cases may be hangingly supported between said pair of rotary discs by said oppositely arranged pins on the circumference of said discs, one of said folded flaps of said card case being further bent at its edge opposite to said bent portion toward the other flap to constitute a slip-preventive section for the information card inserted between the two folded flaps of said card case.

2. The card holder as set forth in claim 1, in which said concentric raised part has around its peripheral surface a plurality of semi-circular recesses, each being commensurate with the outer peripheral surface of each of said pins arranged on the circumference of said rotary disc.

3. The card holder as set forth in claim 1, in which said concentric raised part is smooth around its peripheral surface with a small clearance formed between said raised part and said pins arranged on the circumference of said rotary disc, which is sufficient to permit said pin insertion engagement portion of said card case in it.

4. In a card holder for a rotary type information retrieving device, wherein a plurality of information-containing card cases are hangingly supported between a pair of mutually spaced rotary discs, a combination which comprises:

(a) a plurality of pins arranged on one surface of each of said pair of rotary discs around the circumference thereof and at an equal space interval provided among them; and (b) a plurality of information-containing card cases, each being formed by folding a single sheet of film material into a folder shape with the bent portion being made a pin insertion engagement part in a substantially circular-sectional shape so that said engagement portion may not move in the direction where said pins orthogonally intersect with the axial line thereof, said each card case being supported hangingly on said pair of rotary discs through said oppositely arranged pins on the circumferece of said discs, one of said two bent flaps of said card case being furher bent at its edge opposite to said bent portion toward the other flap to constitute a slip-preventive section for the information card inserted between the two folded flaps of said card case.

* * * * *